United States Patent [19]

Gelzheiser et al.

[11] 4,016,386

[45] Apr. 5, 1977

[54] CIRCUIT BREAKER LINE TERMINAL

[75] Inventors: Francis L. Gelzheiser, Fairfield, Conn.; Gerald J. DeAngelo, Ballwin, Mo.

[73] Assignee: Westinghouse Electric Corporation, Pittsburgh, Pa.

[22] Filed: Aug. 8, 1975

[21] Appl. No.: 603,073

[52] U.S. Cl. ..... 200/250; 200/282; 200/284

[51] Int. Cl.[2] ..... H01H 1/50; H01H 1/42

[58] Field of Search ..... 200/237, 238, 250, 251, 200/258–260, 267, 271, 272, 275, 281, 282, 284; 335/35, 196; 317/119; 339/258, 259

[56] References Cited

UNITED STATES PATENTS

| | | | |
|---|---|---|---|
| 3,053,957 | 9/1962 | Duffield | 200/282 |
| 3,054,025 | 9/1962 | Edmunds | 200/281 X |
| 3,111,354 | 11/1963 | Hammerly et al. | 200/237 X |
| 3,271,549 | 9/1966 | Gelzheiser | 200/250 |
| 3,333,078 | 7/1967 | Gelzheiser et al. | 317/119 X |
| 3,383,486 | 5/1968 | Powell | 200/250 |
| 3,402,328 | 9/1968 | Gryctko | 317/119 |

*Primary Examiner*—James R. Scott
*Attorney, Agent, or Firm*—L.P. Johns

[57] ABSTRACT

A circuit breaker line terminal characterized by an insulating housing having an opening, a plug-in type terminal structure having a terminal and being positioned near the opening and resiliently engageable with a stab on a panel board, a single integral flange on the terminal, a spring clip on the flange for holding a stab in good electrical contact against the flange, the stationary contact being mounted on the terminal, the flange being aligned with the opening, and the spring clip comprising resilient legs on opposite sides of the flange with the ends of the legs facing the opening.

5 Claims, 7 Drawing Figures

CIRCUIT BREAKER LINE TERMINAL

BACKGROUND OF THE INVENTION

1. Field of the Invention

The invention relates to a line terminal for a circuit breaker.

2. Description of the Prior Art

Line terminals for circuit breakers have been fabricated from sheet stock of copper alloy. In view of the increased cost of copper alloy material it has been desirable economically to reconsider the amount of material used in the line terminals to date and to reconsider the possibility of reducing the amount of material used without detracting from the quality of the terminal.

SUMMARY OF THE INVENTION

It has been found in accordance with this invention that the amount of copper alloy material used heretofore in line terminals for duplex or twin circuit breakers can be minimized by providing a circuit breaker for use with a panel board, comprising an insulating housing including an opening in an edge wall thereof, a circuit breaker mechanism within the housing and comprising stationary and movable contacts, a plug-in type terminal structure, the terminal structure being positioned near the opening and resiliently engageable with a stab on the panel board, the terminal structure comprising a terminal, a single integral flange on the terminal, a spring clip on the flange for holding a stab in good electrical contact against the flange when the circuit breaker is mounted on the panel board, the stationary contact being mounted on the terminal, the flange being aligned with the opening, and the spring clip being a C-shaped member composed of a resilient material having leg portions disposed on opposite sides of the flange, and the terminal structure and flange being composed of a copper base metal and the spring clip being composed of steel.

The advantage of the line terminal of this invention is that approximately 33% less material is required for the terminals of this invention than was required for line terminals provided heretofore.

DESCRIPTION OF THE PREFERRED EMBODIMENT

Figure 2:
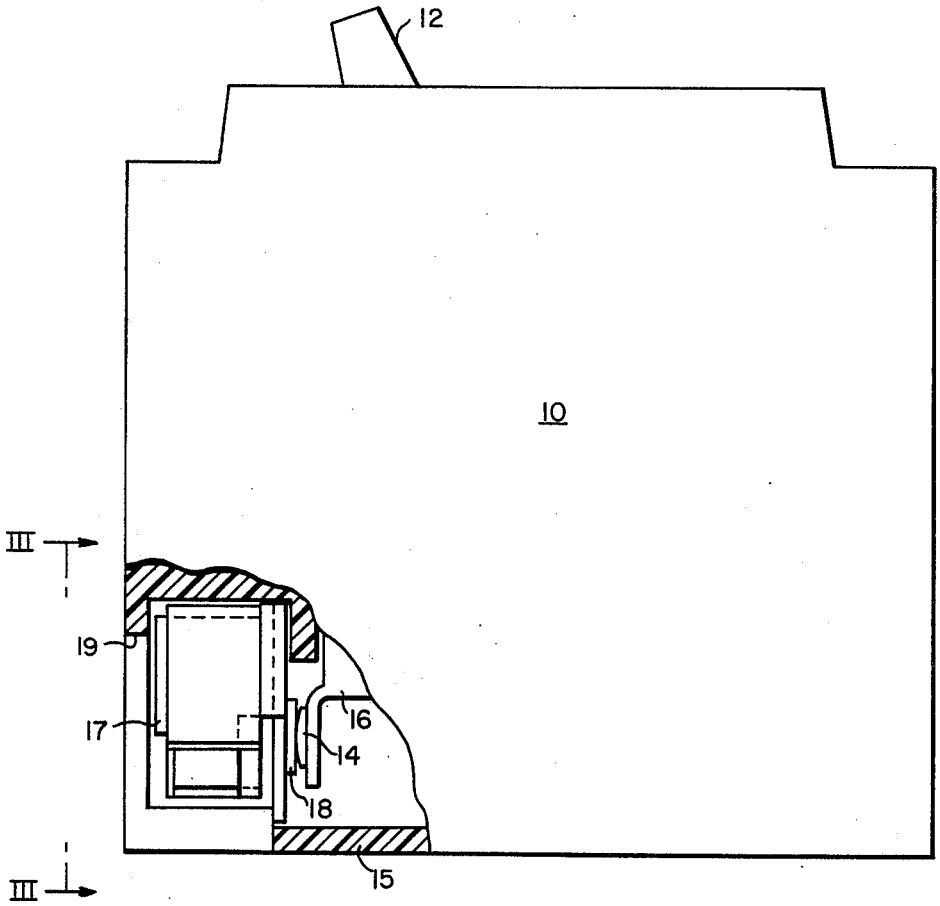
FIG. 2 is a side view of a circuit breaker having a portion broken away showing a terminal structure with the movable contact in the closed position therewith.
Figure 3:
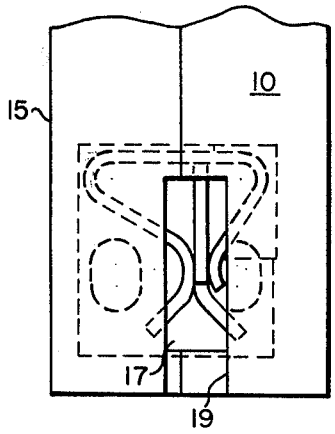
FIG. 3 is an end view taken on the line III—III of FIG. 2.

The terminal structure of this invention is employed in a circuit breaker of conventional construction, such as that disclosed in U.S. Pat. No. 3,760,308 and icorporated as part hereof. In that patent a circuit breaker, similar to a circuit breaker generally indicated at 10 in FIG. 2, is provided with a handle 12 for operating a circuit breaker mechanism (not shown) which includes a movable contact 14 that is mounted at the lower end of a movable arm 16 and that is in a closed position with a stationary contact 18. A line terminal 17 is located in a housing 15 of the circuit breaker 10, the terminal being adjacent to and in alignment with an opening 19 in the housing.

Figure 1:
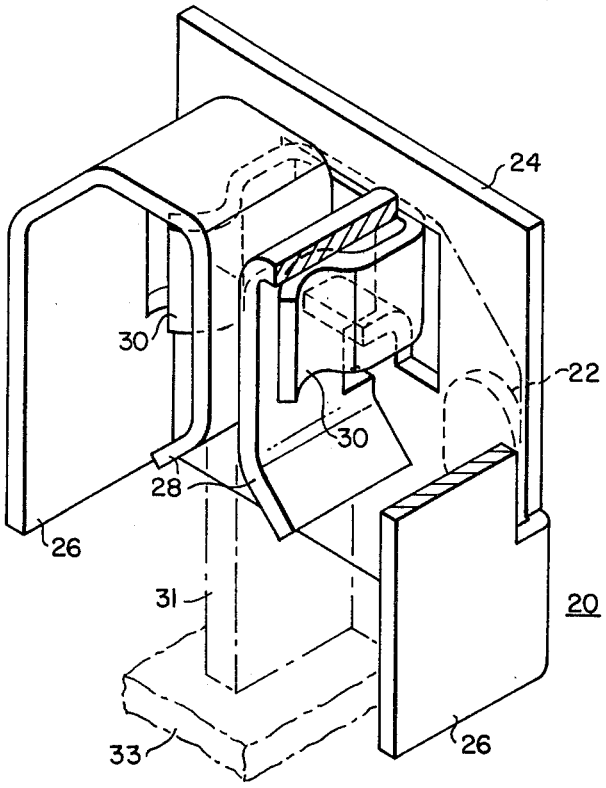
FIG.1 PRIOR ART
FIG. 1 is a perspective view of a termiinal of prior art construction.

In prior art terminal sructure, such as terminal 20 shown in FIG. 1, one or two stationary contacts 22 were fixedly mounted on the terminal base 24 that includes a pair of similar integral flanges 26 having upper end portions which are turned inwardly and downwardly toward the center of the base 24 to form resilient legs 28 which are spaced apart slightly for an engagement with opposite sides of a stab of a panel board. The legs 28 are reinforced by a spring clip 30 for holding the legs resiliently in good electrical contact with a stab 31 of a panel board 33. It is customary to form the terminal 20 from sheet metal composed of a copper base alloy which is a relatively expensive material. The terminal 20 is costly to the extent that a considerable amount of sheet metal is required for the particular structure shown in FIG. 11. To minimize the unit cost of the terminal, substitute terminals 32 and 34 (FIGS. 2–7) have the advantage of being composed of less sheet metal without sacrificing the quality of electrical contact required for the particular purpose for which the terminals 32 and 34 are used.

Figure 4:
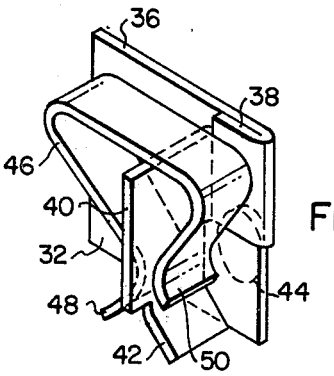
FIG. 4 is a perspective view of the terminal of this invention.
Figure 5:
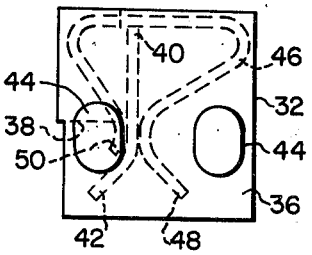
FIG. 5 is a rear view of the device shown in FIG. 4.

As shown in FIGS. 4 and 5 the terminals 32 comprises a plate 36 which includes an overlapped or doubled-back portion 38 from which a portion a flange 40 extends. The doubled-back portion 38 is in surface-to-surface contact with the adjacent surface of the plate 36 to provide good electrical contact therebetween. The lower end of the flange 40 includes an out-turned member 42. As shown in FIG. 5 one or two stationary contacts 44 are mounted on the side of the base plate 36 opposite the flange 40 in a manner similar to the contacts 22 (FIG. 1). A spring clip 46 is mounted on the terminal 32 and includes an out-turned end portion 48 on the side of the flange opposite another out-turned portion 50.

In the unexpanded position the spring clip 46, which is composed of a resilient material such as spring steel, the lower leg portions of the clip are in engagement with opposite sides of the flange 40 with the out-turned end portion 48 extending downwardly and outwardly so as to provide in combination with the out-turned member 42 preshaped means for guiding the entrance of a stab between the flange 40 and the clip 48, with the clip holding the flange in tight surface-to-surface contact with the flange. The terminal 32 using about one-half of the amount of copper base sheet material used in the terminal 20 of FIG. 1.

Figure 6:
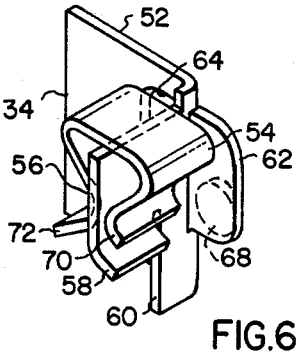
FIG. 6 is a perspective view of another embodiment of the terminal of this invention.
Figure 7:
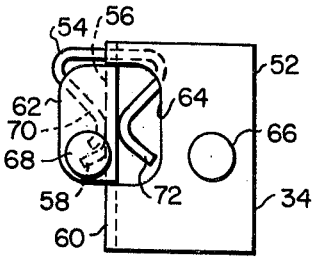
FIG. 7 is a rear view of the device shown in FIG. 6.

The terminal 34 is another embodiment of the invention as shown in FIGS. 6 and 7. It comprises a terminal member 52 as well as a spring clip 54. The larger area portion of the terminal member 52 is flat and includes an out-turned flange 56 which is bent over at approximately 90° to the member. The lower end portion 58 of the flange 56 is inclined outwardly from the edge 60. In addition an out-turned surface member 62 is extruded out of the terminal member 52, leaving an opening 64. The surface member 62 is a projection of the plane of the terminal member 52 because it is preferably disposed in the same plane and is bent along the edge 60.

A pair of contacts 66, 68 (FIG. 7) are disposed on the side of the terminal member 52 and the surface member 62 opposite the flange 56, which contacts are adapted for engagement with the stationary contact 22 in a manner similar to that shown in FIG. 2. The spring clip 54, being similar to the spring clip 46, is mounted on the flange 56 and includes inturned leg portions having one lower out-turned extremity 70 disposed against one side of the flange 56 and another out-turned extremity 72 disposed on the opposite side and in substantial cooperation with the lower out-turned end portion 58. Thus, the extremity 72 and end portion 58 provide guide means for the insertion of a stab (not shown) in position between the flange 56 and the extremity 72 where the spring clip retains the stab in tight surface-to-surface abutment with the flange for good electrical contact.

In summary, the terminals 32 and 34 constitute suitable substitute for the terminal 20 of the prior art type. The terminals 32 and 34 being devoid of the elongated pair of flanges 26 of the terminal 20 include smaller amounts of sheet metal stock composed of copper based material. Each terminal 32, 34 include only one flange 40 by which contact is made with a stab of a panel board and in addition comprises the spring clips 46, 54 for holding a stab in tight surface-to-surface contact with the flange for good electrical contact. Finally, inasmuch as the terminal 32 includes a double-backed portion 38 having a coextensive surface-to-surface contact with the base plate 36, as compared with the lack of such doubled-back portion between the flange 56 and the terminal member 52 of the terminal 34, the former terminal 32 as a higher current carrying capacity than the latter.

What is claimed is:

1. A circuit breaker for use with a panel board, comprising an insulating housing including an opening in an edge wall thereof, a circuit breaker mechanism within the housing and comprising stationary and movable contacts, a plug-in-type terminal structure, the terminal structure being positioned near the opening and resiliently engageable with a stab on the panel board, the terminal structure comprising a terminal, a single integral flange on the terminal, a spring clip on the flange for holding a stab in good electrical contact against the flange when the circuit breaker is mounted on the panel board, the stationary contact being mounted on the terminal, the flange being aligned with the opening, and the spring clip comprising resilient legs on opposite sides of the flange with the ends of the legs facing the opening.

2. The circuit breaker of claim 1 in which the spring clip is a C-shaped member composed of a resilient material and having leg portions disposed on opposite sides of the flange.

3. The circuit breaker of claim 2 in which the flange lower outturned end portion facing the opening in the housing.

4. The circuit breaker of claim 3 in which the spring clip has a lower outturned end portion opposite to the lower outturned end portion of the flange, and both outturned end portions being cooperable with each other to guide a stab into place between the flange and the spring clip.

5. The circuit breaker of claim 1 in which the terminal structure is composed of a copper-base metal and the spring clip is composed of steel.

* * * * *